US006533991B1

(12) United States Patent
Moller

(10) Patent No.: US 6,533,991 B1
(45) Date of Patent: Mar. 18, 2003

(54) COOLING GAS INJECTION NOZZLE FOR A VACUUM HEAT TREATING FURNACE

(75) Inventor: Craig A. Moller, Roscoe, IL (US)

(73) Assignee: Ipsen International, Inc., Cherry Valley, IL (US)

( * ) Notice: Subject to any disclaimer, the term of this patent is extended or adjusted under 35 U.S.C. 154(b) by 0 days.

(21) Appl. No.: 09/597,496

(22) Filed: Jun. 20, 2000

(51) Int. Cl.[7] ..... C21D 1/74
(52) U.S. Cl. ..... 266/250; 266/266; 266/270
(58) Field of Search ..... 266/217, 249, 266/250, 266, 270

(56) References Cited

U.S. PATENT DOCUMENTS 2,734,738 A * 2/1956 Even ..... 266/270
4,285,504 A * 8/1981 Colvin ..... 266/266

* cited by examiner

*Primary Examiner*—Scott Kastler
(74) *Attorney, Agent, or Firm*—Dann, Dorfman, Herrell and Skillman, P.C.

(57) ABSTRACT

A nozzle for injecting a cooling gas in a vacuum heat treating furnace is described. The cooling gas injection nozzle according to the present invention has a forward portion with a first central opening formed therethrough. The cooling gas injection nozzle also has a rear portion with a second central opening formed therethrough. A flap is disposed in and pivotably supported in the first central opening. The flap operates to substantially prevent the escape of heat from the hot zone during a heating cycle, but permits the injection of the cooling gas into the furnace hot zone during a cooling cycle. The cooling gas injection nozzle is supported from the hot zone wall by any appropriate means. A vacuum heat treating furnace and a hot zone therefor incorporating the cooling gas injection nozzle are also described.

27 Claims, 5 Drawing Sheets

COOLING GAS INJECTION NOZZLE FOR A VACUUM HEAT TREATING FURNACE

FIELD OF THE INVENTION

This invention relates generally to vacuum heat treating furnaces, and in particular, to a nozzle for injecting a cooling gas into the hot zone of such a furnace.

BACKGROUND OF THE INVENTION

Many of the known vacuum heat treating furnaces available hitherto, incorporate cooling gas injection systems to provide rapid cooling of metal parts from the elevated heat treatment temperature. Among the components of the cooling gas injection system used in such furnaces are a plurality of nozzles for conducting the cooling gas into the furnace hot zone. The gas injection nozzles used in the known systems are generally tubular or cylindrical in shape and have a central opening that extends along the length of the nozzle.

A problem arises when using such nozzles in a vacuum heat treating furnace because the known nozzles have unobstructed openings therethrough, and heat can be lost from the hot zone during the heating cycle. Heat loss occurs when the heated atmosphere in the furnace hot zone exits the hot zone through the cooling gas nozzles and is cooled in the plenum or, in a plenumless furnace, in the space between the hot zone and the furnace wall. The heated gas is cooled as it traverses the plenum or the annular space between the hot zone and the water-cooled furnace wall in a plenumless furnace and reenters the hot zone at a lower temperature. This problem occurs in vacuum furnaces that utilize convection heating, as well as those that utilize radiant heating of the metal work pieces.

Such heat loss results in a non-uniform heating of the metal parts. When the metal parts do not uniformly attain the desired heat treating temperature, the properties desired from the parts are not achievable.

Consequently, a need has arisen for a cooling gas injection nozzle which substantially prevents the heat in the hot zone from exiting the hot zone during a convection or other heating cycle. Some furnaces have incorporated mechanically actuated dampers or covers on the cooling nozzles. However, such devices are operated from outside the vacuum furnace and thus require complex mechanical linkage systems. It would be highly desirable to have a simple device for injecting cooling gas into a vacuum heat treating furnace which substantially inhibits the escape of heated gas therethrough.

SUMMARY OF THE INVENTION

The problems discussed above are resolved to a large degree by a cooling gas injection nozzle for a vacuum heat treating furnace in accordance with this invention. The gas injection nozzle according to the present invention includes a forward portion having a first central opening formed therethrough. The nozzle also has a rear portion with a second central opening formed therethrough. A flap is disposed in and pivotably supported in the first central opening. This flap operates to substantially prevent the escape of heated atmosphere from the hot zone during a heating cycle, but to permit the injection of a cooling gas into the furnace hot zone during a cooling cycle. The nozzle according to the present invention is supported from the hot zone wall by any appropriate means.

In accordance with another aspect of the present invention there is provided a vacuum heat treating furnace having a vacuum vessel, a hot zone disposed in said vacuum vessel, and a plurality of cooling gas injection nozzles as described above which are disposed in said hot zone. In accordance with a further aspect of the present invention, there is provided a hot zone for a vacuum heat treating furnace that includes a closed wall defining an internal volume, insulation disposed over an interior surface of the closed wall, and a plurality of cooling gas injection nozzles as described above disposed in the hot zone.

BRIEF DESCRIPTION OF THE DRAWING

The foregoing summary, as well as the following detailed description of a preferred embodiment of the present invention, will be better understood when read in conjunction with the drawings, in which.

DETAILED DESCRIPTION

Figure 1:
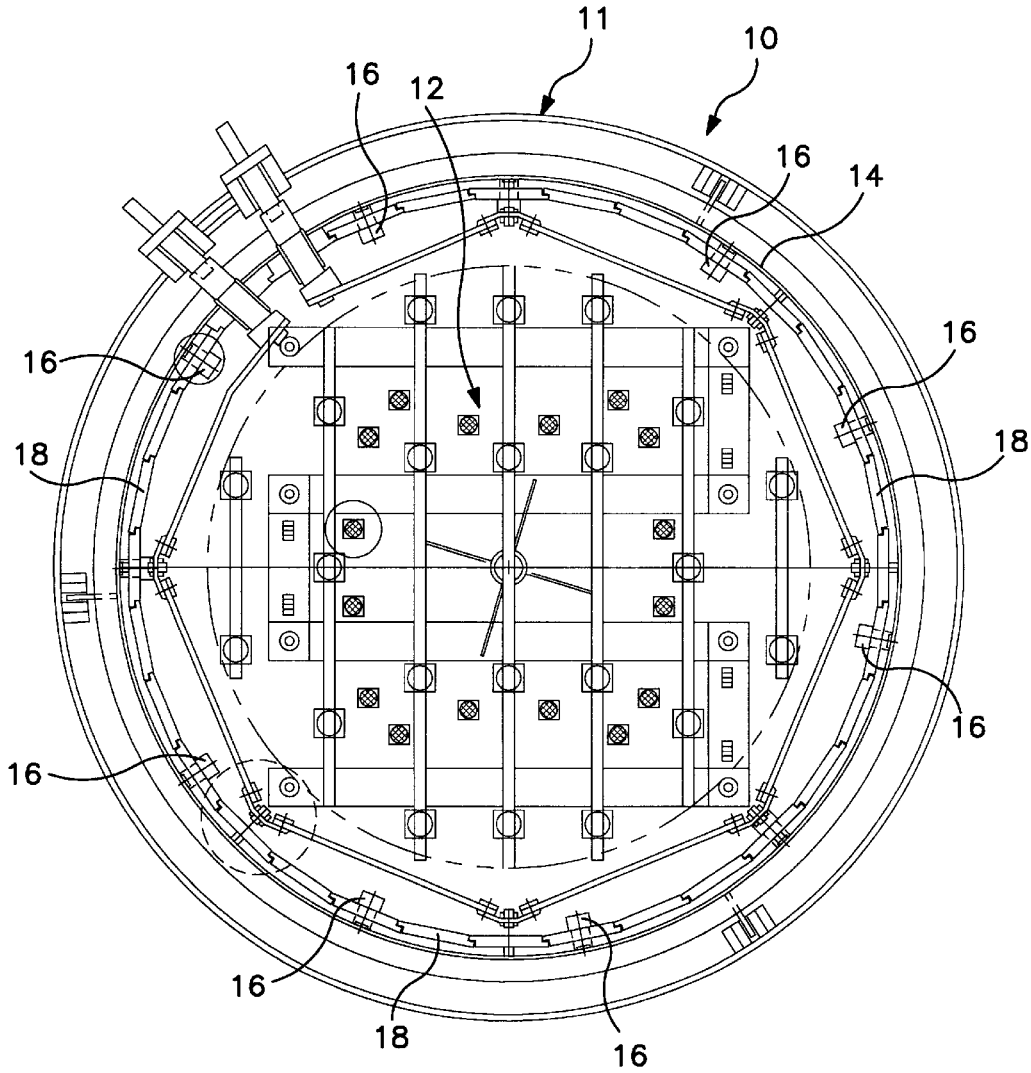
FIG. 1 is a plan view of the interior of a vacuum heat treating furnace in accordance with the present invention.

Referring now to the drawings wherein like reference numerals refer to the same or similar elements across the several views, and in particular to FIG. 1, there is shown generally a vacuum heat treating furnace 10. The vacuum heat treating furnace 10 includes a vacuum vessel 11 and a hot zone 12. The hot zone 12 is a space defined by a closed wall 14 wherein a charge of metal parts to be heat treated is positioned. In the embodiment shown in FIG. 1, the space is substantially cylindrical. However, the space may have other cross-sectional shapes such as square, rectangular, or polygonal, as known to those skilled in the art. The vacuum vessel 11 shown in FIG. 1 is a vertically oriented vessel, but the invention is also applicable to horizontally oriented furnaces.

The hot zone 12 further includes a layer of thermal insulation 18 that substantially covers the interior surface of the hot zone wall 14. A plurality of gas injection nozzles 16 are disposed in the hot zone to provide a means for injecting a cooling gas into the hot zone 12 during an operating cycle of the heat treating furnace when the metal parts are to be cooled from the heat treating temperature. The gas injection nozzles 16 extend through the insulation 18 and are fastened to the hot zone wall 14 by any appropriate means. This arrangement can be seen more easily in FIG. 3. Suitable fastening means include pins, bolts, wires, threads, twist-lock tabs, or retaining clips. The means for attaching the nozzle to the hot zone wall preferably provides for easy installation and removal of the nozzle to facilitate assembly and maintenance of the heat treating furnace and/or its hot zone. A preferred means for attaching the nozzle to the hot zone wall is described more fully below.

Figure 2:
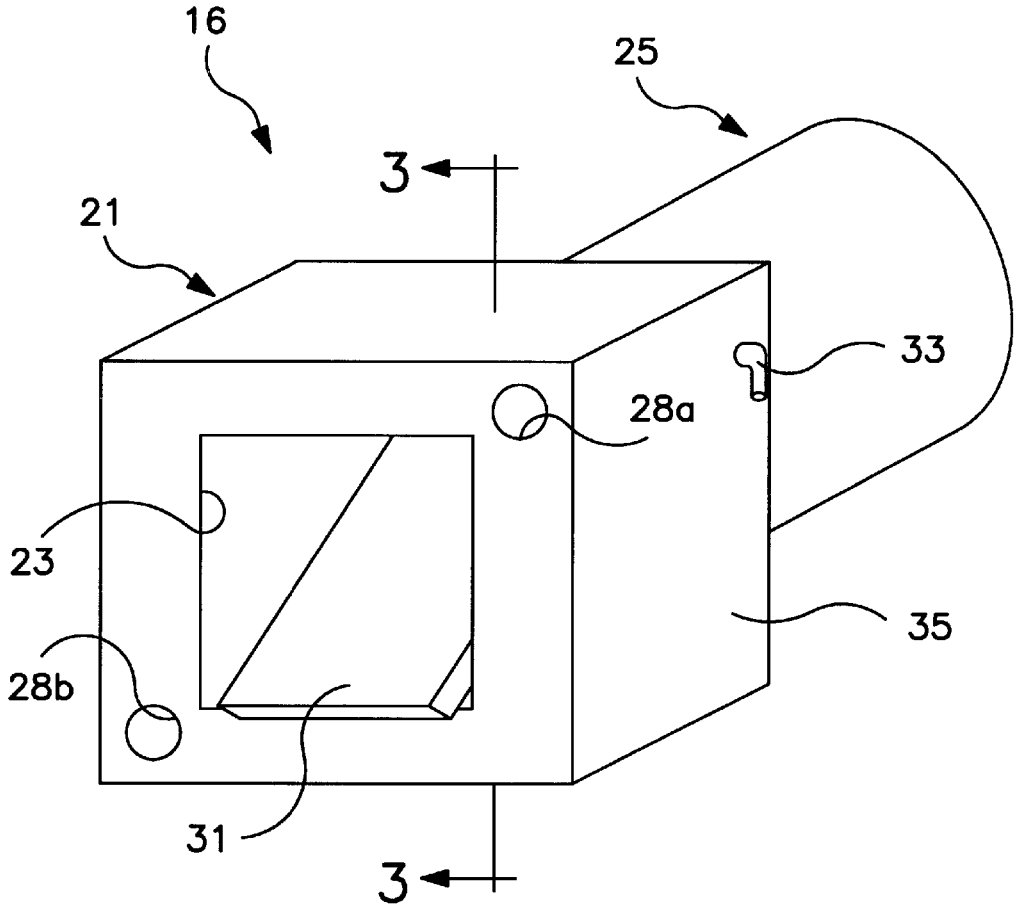
FIG. 2 is a perspective view of a cooling gas nozzle in accordance with the present invention.
Figure 3:
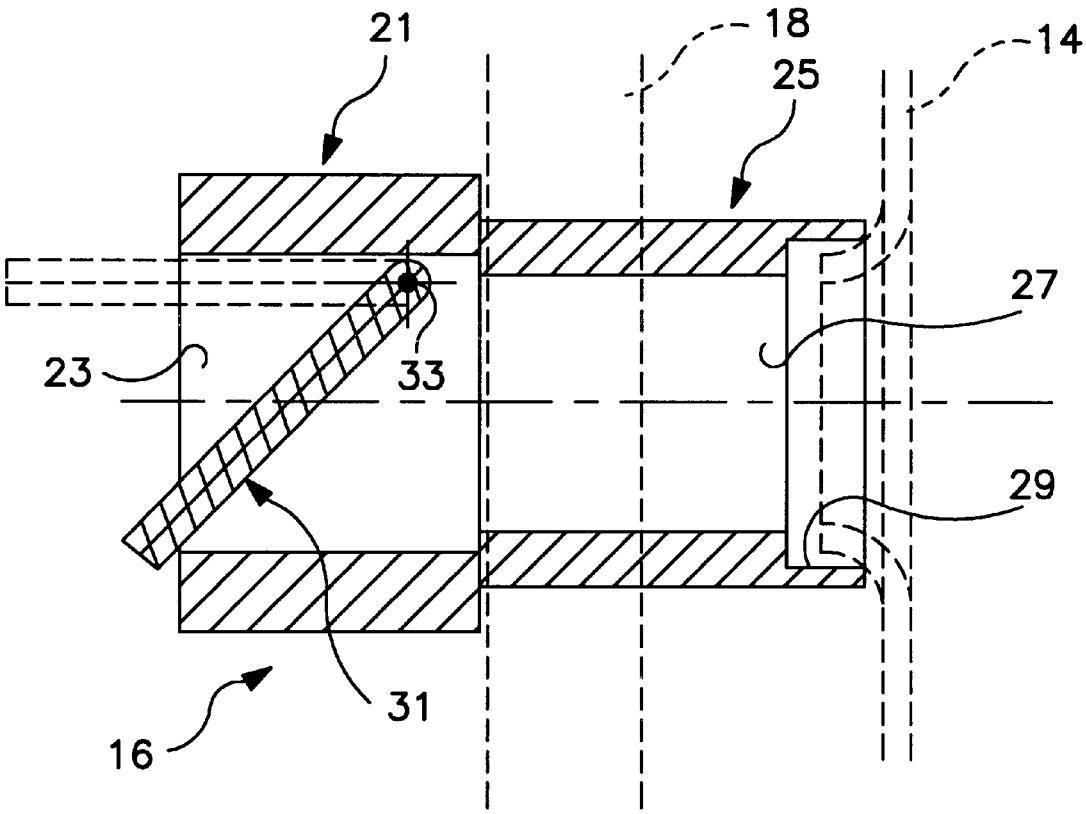
FIG. 3 is a cross-sectional side elevation view of the cooling gas nozzle of FIG. 2 as viewed along line 3—3 therein.
Figure 4:
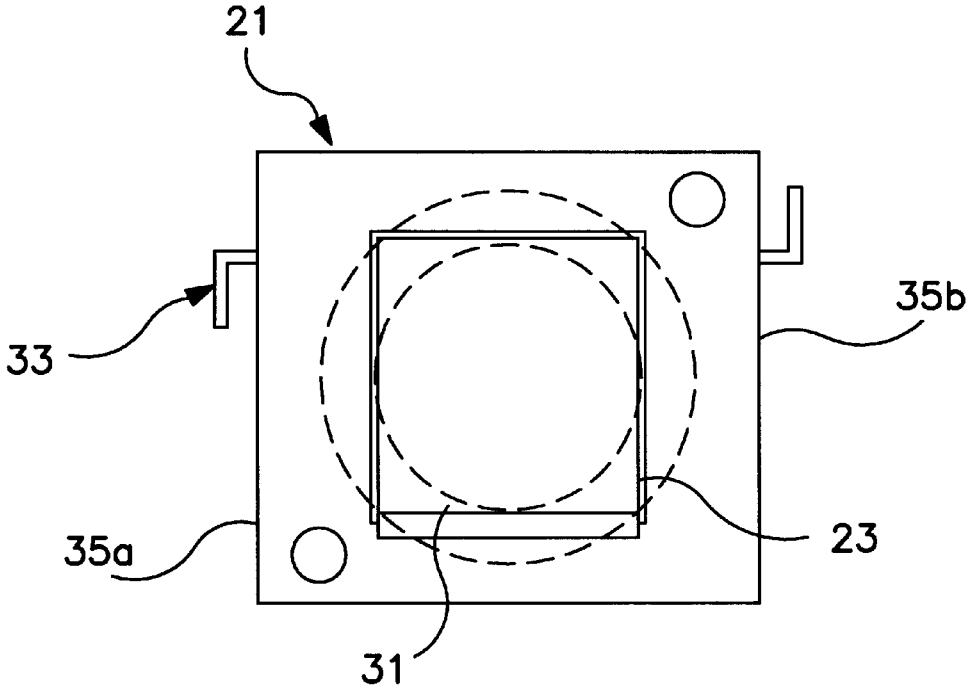
FIG. 4 is a front elevation view of the cooling gas nozzle of FIG. 2.
Figure 5:
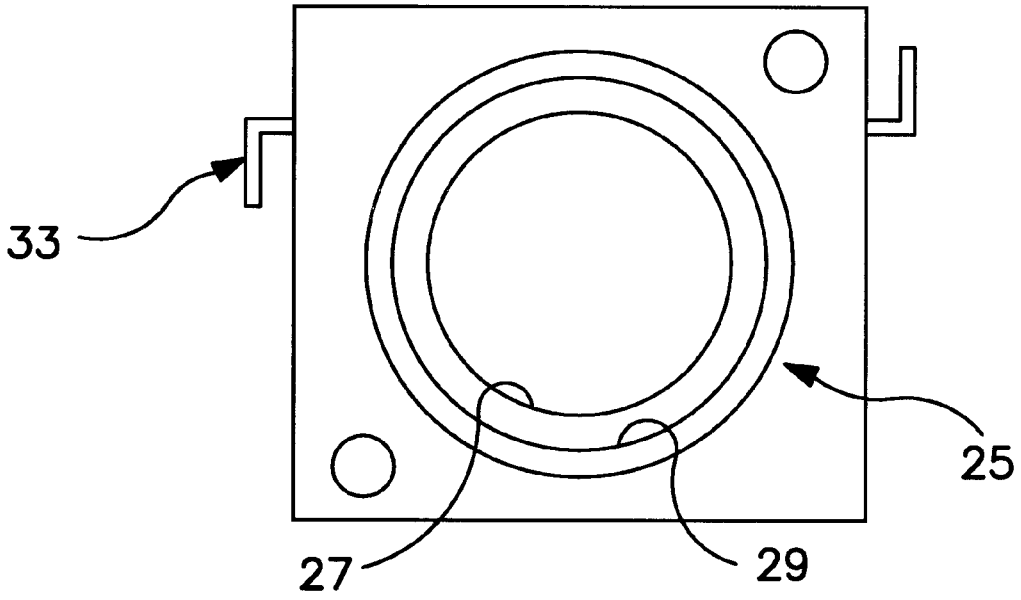
FIG. 5 is a rear elevation view of the cooling gas nozzle of FIG. 2.

Referring now to FIGS. 2–4, the gas cooling nozzle will be described in greater detail. The gas injection nozzle 16 is formed of a forward portion 21 which is exposed in the hot zone 12 and a rear portion 25 which extends through the insulation 18 and is attached to the hot zone wall 14. A first central opening 23 is formed through the length of the forward portion 21 and a second central opening 27 is formed through the length of the rear portion 25. The first central opening 23 and the second central opening 27 are aligned to form a continuous channel through the nozzle 16. The rear portion 25 has an annular recess 29 formed at the end thereof. The annular recess 29 is formed to accommodate a boss on the hot zone wall around an opening therethrough as shown in FIG. 3.

Figure 6:
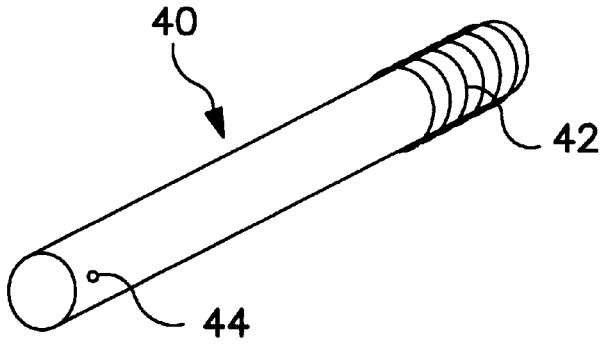
FIG. 6 is a perspective view of a pin used in the cooling gas nozzle of FIG. 2.

A pair of boreholes 28*a* and 28*a* are formed or machined in the nozzle for receiving metal attachment pins (not shown) that attach the nozzle 16 to the hot zone wall 14. A preferred construction for the attachment pins is shown in FIG. 6. A pin 40 has a first end on which a plurality of screw threads 42 are formed to permit the pin 40 to be threaded into a threaded hole (not shown) in the hot zone wall. It will be appreciated that instead of the screw threads 42, the first end of pin 40 can be provided with twist-lock tabs, or a transverse hole for accommodating a retaining clip. The other end of the attachment pin 40 has a transverse hole 44 formed therethrough for receiving a retaining clip (not shown) to hold the nozzle 16 in place.

A flap 31 is disposed in the first central opening 23 and is pivotably supported therein by a pin 33 which traverses holes in the sidewalls 35*a* and 35*b* of forward portion 21. The flap 31 is positioned and dimensioned so as to close the central opening 23 when it is in a first position, thereby preventing, or at least substantially limiting, the transfer of heat out of the hot zone 12 and the unforced introduction of cooler gas into the hot zone through the central channel of the nozzle. In a second position of the flap, as shown in phantom in FIG. 3, the central opening 23 is open to permit the forced flow of cooling gas therethrough into the hot zone 12 during a cooling or quenching cycle. For simplicity, the flap 31 is maintained in the first or closed position by the force of gravity. In such an arrangement the nozzle 16 is preferably oriented such that the flap will be normally closed. In a horizontally oriented vacuum furnace, some of the nozzles in the upper half of the hot zone will necessarily be open a small amount because of the orientation of the nozzles and the effect of gravity on the flap. When it is desired to maintain the flaps of such nozzles in the normally closed position, biasing means, such as a counterweight, can be used. The counterweight should provide sufficient biasing force to maintain the flap in the normally closed position, but the biasing force of the counterweight should be less than the force of the cooling gas on the flap when it is being injected so that the flap can be readily moved to the open position.

The nozzle 16 and the flap 31 are preferably formed from a refractory material such as molybdenum or graphite. They may also be formed of a ceramic material if desired. In the embodiment shown, the forward portion 21 is rectangular in cross section and the rear portion 25 is circular in cross section. However, the shapes of the forward and rear portions of nozzle 16 are not critical. Preferably, the forward portion 21 has a larger cross-sectional area than the rear portion 23 so that the forward portion 21 will press against the thermal insulation 18 to help keep it in place during use of the heat treating furnace. Similarly, the shapes of the first and second central openings 23 and 27 are not critical. The first central opening 23 is preferably square or rectangular for ease of fabrication and the second central opening 27 is preferably circular for ease of adaptation with the opening in the hot zone wall 14.

It will be recognized by those skilled in the art that changes or modifications may be made to the above described embodiments without departing from the broad, inventive concepts of the invention. It is understood, therefore, that the invention is not limited to the particular embodiment(s) disclosed, but is intended to cover all modifications and changes which are within the scope and spirit of the invention as defined in the appended claims.

What is claimed is:

1. A nozzle for injecting cooling gas into the hot zone of a vacuum heat treating furnace comprising:

a forward portion having a first central opening formed therethrough;

a rear portion having a second central opening formed therethrough;

said first central opening being in communication with said second central opening to form a gas flow channel extending through the length of the nozzle;

a flap disposed in the gas flow channel, said flap being adapted for substantially limiting the transfer of heat out of the hot zone through said gas flow channel and for substantially limiting the unforced introduction of cooler gas into the hot zone through said gas flow channel;

means for pivotably supporting said flap in the first central opening such that forced cooling gas flowing in the gas flow channel displaces said flap from a closed position to an open position whereby the cooling gas can be injected into the furnace hot zone; and means for supporting said nozzle in the hot zone.

2. A nozzle as set forth in claim 1 wherein the flap comprises a generally planar piece of a refractory material.

3. A nozzle as set forth in claim 2 wherein the flap is dimensioned for substantially closing the gas flow channel.

4. A nozzle as set forth in claim 1 wherein the means for supporting the nozzle comprises threads formed on said rear portion of the nozzle.

5. A nozzle as set forth in claim 1 wherein the first central opening is generally rectangular in cross section.

6. A nozzle as set forth in claim 1 wherein the support means for said flap comprises a pin extending through said flap and extending into holes in said forward portion of the nozzle such that said flap is retained in said first central opening.

7. A nozzle as set forth in any of claims 1–6 which is formed from a refractory material.

8. A nozzle as set forth in claim 7 which is formed from a refractory material selected from the group consisting of refractory metals, graphite, ceramics, and combinations thereof.

9. A nozzle as set forth in claim 8 which is formed of graphite.

10. A vacuum heat treating furnace comprising:

a vacuum vessel;

a hot zone disposed in said vacuum vessel; and a plurality of nozzles for injecting a cooling gas into the hot zone, each of said nozzles comprising:

a forward portion having a first central opening formed therethrough;

a rear portion having a second central opening formed therethrough;

said first central opening being in communication with said second central opening to form a gas flow channel extending through the length of the nozzle;

a flap disposed in the gas flow channel, said flap being adapted for substantially limiting the transfer of heat out of the hot zone through said gas flow channel and for substantially limiting the unforced introduction of cooler gas into the hot zone through said gas flow channel;

means for pivotably supporting said flap in the first central opening such that forced cooling gas flowing in the gas flow channel displaces said flap from a closed position to an open position whereby the cooling gas can be injected into the furnace hot zone; and means for supporting said nozzle in the hot zone.

11. A vacuum furnace as set forth in claim 10 wherein the flap comprises a generally planar piece of a refractory material.

12. A vacuum furnace as set forth in claim 11 wherein the flap is dimensioned for substantially closing the gas flow channel.

13. A vacuum furnace as set forth in claim 10 wherein the means for supporting the nozzle comprises threads formed on said rear portion of the nozzle.

14. A vacuum furnace as set forth in claim 10 wherein the first central opening is generally rectangular in cross section.

15. A vacuum furnace as set forth in claim 10 wherein the support means for said flap comprises a pin extending through said flap and extending into holes in said forward portion of the nozzle such that said flap is retained in said first central opening.

16. A vacuum furnace as set forth in any of claims 10–15 which is formed from a refractory material.

17. A vacuum furnace as set forth in claim 16 which is formed from a refractory material selected from the group consisting of refractory metals, graphite, ceramics, and combinations thereof.

18. A vacuum furnace as set forth in claim 17 which is formed of graphite.

19. A hot zone for a vacuum heat treating furnace comprising:

a closed wall defining an internal volume;

insulation means disposed over an interior surface of said closed wall; and a plurality of nozzles for injecting a cooling gas into the hot zone, each of said nozzles comprising:

a forward portion having a first central opening formed therethrough;

a rear portion having a second central opening formed therethrough;

said first central opening being in communication with said second central opening to form a gas flow channel extending through the length of the nozzle;

a flap disposed in the gas flow channel, said flap being adapted for substantially limiting the transfer of heat out of the hot zone through said gas flow channel and for substantially limiting the unforced introduction of cooler gas into the hot zone through said gas flow channel;

means for pivotably supporting said flap in the first central opening such that forced cooling gas flowing in the gas flow channel displaces said flap from a closed position to an open position whereby the cooling gas can be injected into the furnace hot zone; and means for supporting said nozzle in the hot zone.

20. A hot zone as set forth in claim 19 wherein the flap comprises a generally planar piece of a refractory material.

21. A hot zone as set forth in claim 20 wherein the flap is dimensioned for substantially closing the gas flow channel.

22. A hot zone as set forth in claim 19 wherein the means for supporting the nozzle comprises threads formed on said rear portion of the nozzle.

23. A hot zone as set forth in claim 19 wherein the first central opening is generally rectangular in cross section.

24. A hot zone as set forth in claim 19 wherein the support means for said flap comprises a pin extending through said flap and extending into holes in said forward portion of the nozzle such that said flap is retained in said first central opening.

25. A hot zone as set forth in any of claims 19–24 which is formed from a refractory material.

26. A hot zone as set forth in claim 25 which is formed from a refractory material selected from the group consisting of refractory metals, graphite, ceramics, and combinations thereof.

27. A hot zone as set forth in claim 26 which is formed of graphite.

* * * * *